United States Patent [19]

Wonnacott

[11] Patent Number: 4,817,866

[45] Date of Patent: Apr. 4, 1989

[54] PACKAGING

[75] Inventor: Roger J. Wonnacott, Launceston, United Kingdom

[73] Assignee: St. Regis Packaging Limited, Launceston, United Kingdom

[21] Appl. No.: 98,594

[22] Filed: Sep. 17, 1987

[30] Foreign Application Priority Data

Sep. 17, 1986 [GB] United Kingdom ..... 8622320
Jul. 20, 1987 [GB] United Kingdom ..... 8717073

[51] Int. Cl.[4] ..... B65D 5/46

[52] U.S. Cl. ..... 206/427; 229/52 B; 206/141; 221/303

[58] Field of Search ..... 206/427, 141; 229/52 B; 221/52 BC, 303

[56] References Cited

U.S. PATENT DOCUMENTS 3,794,239 2/1974 Bonczyk ..... 229/52
4,274,580 6/1981 Arnold ..... 229/52
4,301,922 11/1981 Hamglin et al. ..... 229/52 BC
4,318,474 3/1982 Hasegawa ..... 206/428
4,364,509 12/1982 Holley, Jr. et al. ..... 229/52 B
4,498,619 2/1985 Roccaforte ..... 229/52 B
4,546,914 10/1985 Roccaforte ..... 229/52 B
4,567,070 1/1986 Karass ..... 229/52 B

FOREIGN PATENT DOCUMENTS 1101345 1/1968 United Kingdom .

*Primary Examiner*—Joseph M. Moy
*Attorney, Agent, or Firm*—Dann, Dorfman, Herrell and Skillman

[57] ABSTRACT

A packaging carton (e.g. for cans (31) of drink) comprises a reinforcing tape (18) incorporated in the board material from which the carton is formed which tape reinforces a carrying handle (20) defined by two parallel cuts formed in an end wall of the carton. Access to the contents of the carton are obtained by defining access flaps (23, 24) delimited by lines of weakness (**22*a*, 22*b*) which extend up to the cuts defining the carrying handle. By locating the handle (20**) in the median plane between two rows of cans, free passage of cans from the opening provided by an access flap is prevented by the handle, thus ensuring one-by-one dispensing of the cans from the carton.

10 Claims, 4 Drawing Sheets

PACKAGING

This invention relates to an improved method of packaging a plurality of identically sized articles (such as cans of drink), to an improved packaging carton for putting the method into practice and to a blank for making the carton and operating the method.

In particular, this invention relates to a packaging method, blank and carton which enables the same carton to be used for the retailing of the packaged articles and for their one-by-one dispensing when required.

From U.S. Pat. No. 4,567,070 it is known to provide a reinforced carrying handle on a packaging carton by incorporating a reinforcing tape in a board from which the carton is made and forming the carrying handle in such a position on the board that it includes the incorporated tape. From U.S. Pat. No. 4,318,474 it is also known to provide a packaging carton that has at least one line of weakness formed thereon to delineate the precursor of an opening flap and provide user-easy access to the articles packaged in the carton.

The invention relates to a novel combination of these two known features.

In one aspect of the invention a method of packaging a plurality of rows of identically sized articles in a right parallelepipedic carrying carton comprises enclosing the rows in a black of stiff but foldable material which includes (a) a pair of cuts which define a handle portion of the carton and (b) the precursor of an access opening is characterised in that a length of reinforcing material extends across the blank and is flanked over part of its length by the handle-defining cuts, the length of reinforcing material coinciding with the median plane between two adjacent rows and in that the across opening is defined by two lines of weakness which each terminate at the same one of said handle-defining cuts.

Conveniently the length of reinforcing material extends across four adjacent walls of the carton and thus forms a closed loop in said median plane in the completed carton.

Suitably each of the two walls of the carton which does not include reinforcing material is defined by four flaps which leave a central opening through which the articles can be seen.

Normally the blank is wrapped around the rows of articles.

Preferably the handle-defining cuts extend completely across one wall of the carton and each encroaches slightly on both the adjacent walls of the carton. Each line of weakness can be located in a respective one of the two adjacent walls.

In a further aspect of the invention a blank for packaging a plurality of rows of cylindrical cans comprising panels for defining four walls of a carton, one of said panels including spaced apart cuts defining a carrying handle and at least one line of weakness defining a precursor of an access opening, is characterised in that a length of reinforcing tape is located between the handle-defining cuts and in that there are two spaced-apart lines of weakness which each terminate at one of the handle-defining cuts.

Conveniently the reinforcing tape extends across al four walls, the handle-defining cuts encroach on the panels adjacent to said one panel and the spaced apart lines of weakness are formed one in each of said adjacent panels.

In a still further aspect of the invention a packaging carton formed from a blank of stiff but foldable board material and containing at least two rows of identical cylindrical cans, which carton is of right parallelepipedic shape and comprises a handle which extends parallel to and is intersected by the median plane between two adjacent rows and the precursor of an access flap to gain access to the packaged cans, is characterised in that the access flap is delineated by said handle and by spaced-apart lines of weakness, the handle including reinforcing material which lies in the said median plane and which extends completely across one wall of the carton and at least partly across two of the walls of the carton adjacent to the said one wall, the reinforcing material being located between handle-defining cuts in the board material which encroach onto said two adjacent walls to define the reinforced handle.

Desirably the board material is corrugated fibre board and the reinforcing material is a tape which extends at right angles to the flutes of the corrugations, the tape being disposed between the corrugated sheet and one facing sheet of the board.

Preferably the reinforcing material extends the whole length of the blank and thus surrounds the cans packaged in the carton.

By virtue of the design described, in a carton according to the invention the handle forms an obstruction to free passage of packaged cans through the opening revealed by the access flap when the latter is created by tearing the board material along the lines of weakness.

The reinforcing material can be of any suitable form which can be stuck on or incorporated into the board material. Tape-formed materials or spaced-apart threads can be used but a fibrous reinforcing tape incorporating a hot-melt adhesive is preferred.

The invention will be further described, by way of example, with reference to the accompanying drawings, in which.

Figure 1:
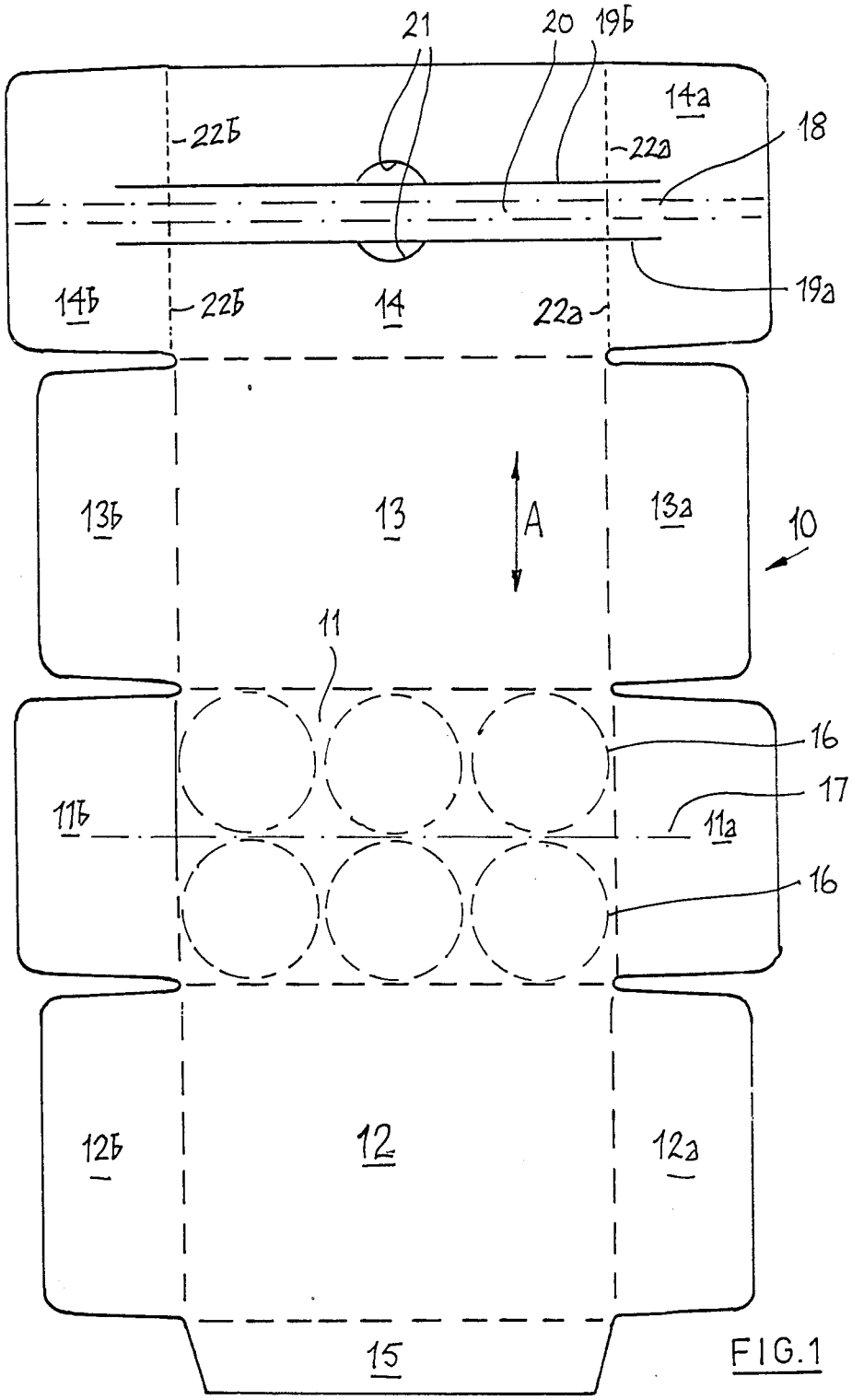
FIG. 1 shows a blank for a first embodiment of carton.

The blank 10 of FIG. 1 is designed for packaging six 440 ml cylindrical cans of drink (e.g. beer or lager). It comprises a base wall 11, two side walls 12 and 13, a top wall 14 and four flaps 11*a*–14*a* and 11*b*–14*b* to make the end walls of the erected carton. A securing flap 15 is formed along one edge of the side wall 12 and is attached to the underside of the top wall 14 as the blank is folded around six cans arranged in two rows of three. The locations of the ends of the cans is shown in dashed lines 16 on the base wall 11, the central or median plane between the two rows of cans being shown at 17. In wrapping the blank around the collated array of six cans, the flaps 12*a*, 13*a* underlie the flaps 11*a* and 14*a* to make one end wall and the flaps 12*b*, 13*b* underlie the flaps 11*b* and 14*b* to make the other end wall.

The folding and gluing (or other fixing method) used to form the carton (shown in FIG. 3) from the blank of FIG. 1 are well known procedures which need not be described in detail here.

When the blank is of double faced corrugated fibreboard, the flutes of the corrugations run in the direction of the arrows A shown in FIG. 1. The pre-formed creases that delimit the walls 11, 12 and 13 and their flaps (11*a*, 12*a*, 13*a*, 11*b*, 12*b*, 13*b* and 15) are conventionally formed and all fold downwardly as shown in FIG. 1.

The important difference in the carton shown in FIG. 1 resides in the top wall 14 and its flaps 14*a*, 14*b*. Embedded between layers of the board material from which the blank is made is a reinforcing tape 18 (e.g. a hot melt adhesive coated polyester fibre tape made by Sesame Industries Ltd. of Quebec, Canada). This tape 18 is centrally located across the top wall 14 and its associated end wall flaps 14*a*, 14*b* and thus will be intersected by the median plane 17 between the two rows of cans when the carton is erected and filled. Two parallel cuts 19*a* and 19*b* are formed one on each side of the tape 18 and these define a carrying handle 20. Cut-outs 21 provide finger access to the handle to lift it clear of the top wall 14, when the filled carton is to be carried. The cuts 19*a* and 19*b* which extend into the end wall flaps 14*a* and 14*b* allow the ends of the handle 20 to move inwardly as the central region of the handle 20 lifts clear of the top wall 14.

The fold lines 22*a*, 22*b* between the top wall 14 and the respective end wall flap 14*a*, 14*b* are perforated or slit-score lines up to the respective cuts 19*a*, 19*b* but are simple unperforated fold lines where they traverse the handle 20. The fold lines 22a, 22b thus define two pairs of lines of weakness in the blank which extend up to the cuts 19*a*, 19*b* and define the precursors of access flaps 23, 24 (see FIG. 3). It is noted that the perforated fold lines 22a and 22b originate at the edge of the top wall panel 14 and terminate in the first of the two cut lines 19*a* and 19*b*, a distance less than the diameter of the cans at 16, but the distance from the edge of the panel to the second of the cut lines is greater than the diameter of the cans at 16. The access flap defined by these lines of weakness 22*a* and 22*b* may be folded along a hinge line substantially parallel to the cut lines 19*a* and 19*b*.

Figure 3:
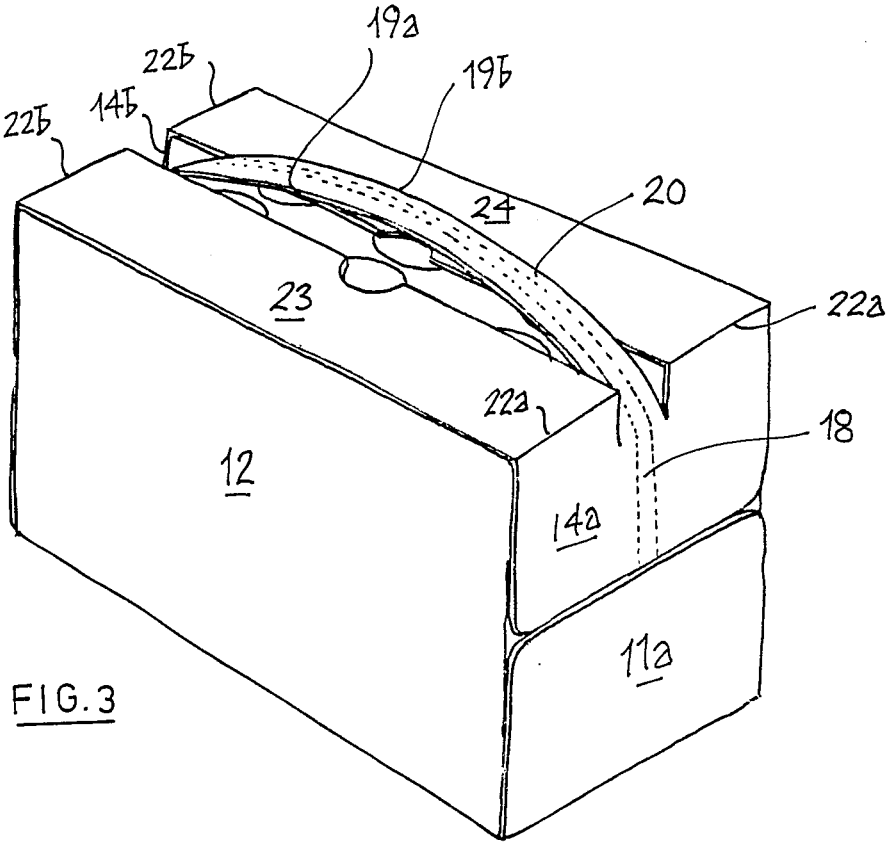
FIG. 3 shows a filled carton erected from the blank of FIG. 1 prepared for carrying.

To dispense cans from the carton shown in FIG. 3, one of the access flaps 23, 24 can be pulled back away from the handle 20 so that the board material is torn along the respective pair of lines of weakness exposing the ends of the cans in one row. The access opening extends from the hinge line at the edge of the panel to the second cut line, but the handle 20 overlies the opening and obstructs escape of cans through the opening.

The blank shown in FIG. 1 is for the six can pack (shown in FIG. 3) but four-, eight-, ten- or twelvecan packs can equally well be produced.

Figure 2:
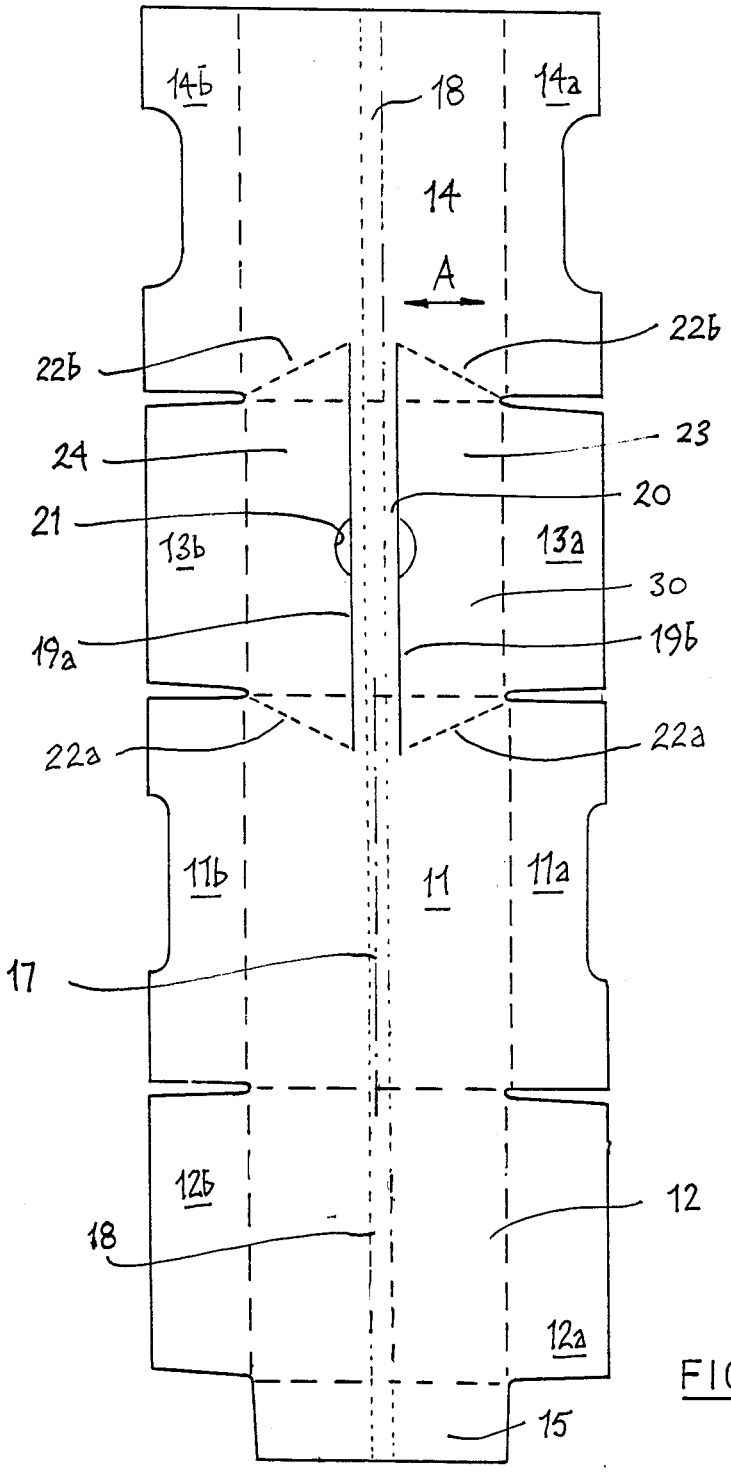
FIG. 2 shows a blank for a second embodiment of carton.
Figure 4:
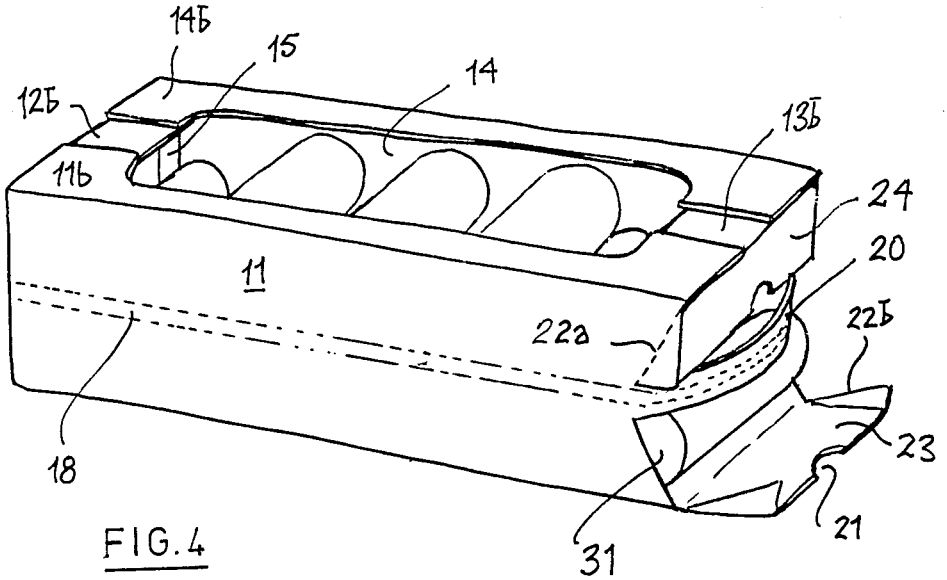
FIG. 4 shows a carton erected from a blank of the general type shown in FIG. 2 with the carbon opened for one-by-one dispensing of its contents.

FIG. 2 shows a second embodiment of black which only partially envelops six cans as can be seen from FIG. 4 (although this shows a larger carton). This embodiment is particularly suitable for one-by-one dispensing (e.g. from a refrigerator) with the rows of cans one above the other. Similar reference numbers have been used in FIGS. 1 and 2 to designate similar integers. The perforated weakness lines 22*a* and 22*b* are angled into the end panels 11 and 14, but provide an obstructed access opening between their hinge line and the cut lines in the same manner as in FIG. 1.

The reinforcing tape 18 now extends the whole length of the blank and the handle 20 is formed in one end wall 30. The lines of weakness 22*a*, 22*b* do not coincide with the fold lines between the base wall 11 and the end wall 30 and between thr top wall 14 and to end wall 30 but rather extend at an angle to terminate at the ends of the respective cuts 19*a*, 19*b*.

The carton of FIG. 4 is for twelve cans (rather than the four which would be accommodated in the blank of FIG. 2) and can be carried safely using the reinforced handle 20. When can dispensing is required, the lower one of the access flaps 23, 24 is torn back using the lines of weakness and the first can available can be removed from under the handle 20. As the first can is removed another (e.g. can 31 from the upper row) takes its place but this second can will be retained in the carton by the presence of the reinforced handle 20 which, since it lies symmetrically with respect to the median plane 17, will act as a stop to free passage of cans from the carton.

Figure 5:
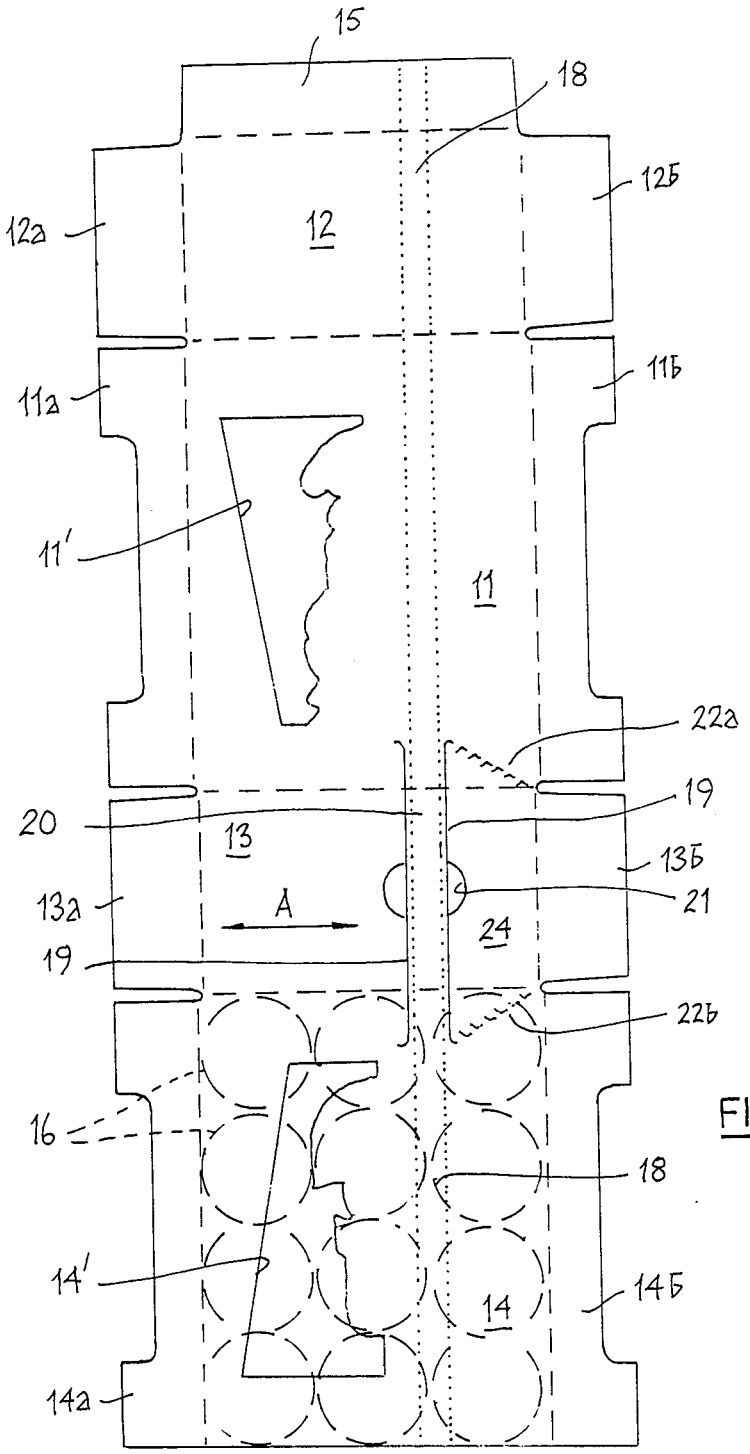
FIG. 5 represents a plan of a blank for a third embodiment of carton.

The blank shown in FIG. 5 is designed for wrapping around twelve cylindrical cans in three rows of four cans per row to form a carrying carton which displays the sides of the cans and the ends of some of the cans. The same reference numerals have been used in FIG. 5 as were used in the earlier Figures to denote similar items and only the main features of difference between the blank of FIG. 5 and the blank of FIG. 2 will be discussed here.

Because the blank of FIG. 5 is designed to envelop 3 rows, the reinforcing material 18 (which could be Sesame tape, a plurality of threads or wires or a tape of plastics film) is located $\frac{1}{3}\frac{2}{3}$ across the walls 11, 12, 13 and 14 so that it lies in the median plane between two adjacent rows. This means that the access flap 24, although at least as long as a can, is not as wide as the diameter of a can by an amount roughly half the width of the reinforced handle 20. Thus one-by-one dispensing of the cans can easily be provided through the opening left when the access flap 24 is broken away along the lines of weakness 22*a*, 22*b*, each formed in the adjacent walls 11 and 14 by a line of generally L-shaped cuts.

If the carton made from the blank of FIG. 5 is supported so that wall flaps 11*b*, 12*b*, 13*b*, and 14*b* define the base of the carton, cans can be taken one-by-one from the carton from all three rows without needing to tip the carton until the final row comes to be removed since the row structure naturally collapses as the cans are removed. The location of the lines of weakness 22*a*, 22*b* in the walls 11 and 14 means that regions of the opposite ends of the can retained in the access opening can be grasped to assist in removing the can from below the handle 20.

The openings 11' and 14' formed in the walls 11 and 14 display can ends and either or both opening(s) can be shaped along at least the irregular edges shown to accommodate advertising material.

The off-set location of the handle 20 does not interfere with the carrying of the carton and its cans, but does, as explained, at as a "gate" to facilitate removal of the cans one-by-one.

Similar cartons for different numbers of cans in more than two rows are clearly possible.

The outline of the twelve can ends is shown schematically at 16 on wall 14 of the blank of FIG. 5.

The carton and method of this invention are expected to find their most important commercial application in the drinks industry, but it should be appreciated that the invention is not limited to that end-use. Thus although articles of circular shape are very suitably packaged in accordance with this invention two or more rows of articles of polygonal (e.g. rectangular) cross-section can equally well be employed.

What is claimed is:

1. A right parallelepipedic packaging carton formed of stiff folded board material to define four walls and two sides and containing two rows of identical cylindrical cans disposed side by side with a median plane defined between the rows, the four walls including a strip of reinforcing material which extends completely around the carton and is intersected by said median plane, the reinforcing strip being flanked by cuts in its passage across one wall to define a carrying handle for the carton and its contents, the said two cuts extending into the two walls which are adjacent to said one wall, the carton also including two lines of weakness each of which extends from one of said two cuts in a respective one of the said two walls towards an outer edge of the carton whereby, on forming an access opening in the carton by tearing the board material along said two lines of weakness and displacing the torn board along said outer edge as a hinge, the handle forms an obstruction to free passage of packaged cans through the said opening.

2. A carton as claimed in claim 1 in which the two sides of the carton are partially open to allow sight of the cans contained therein.

3. A packaging carton formed from a blank of stiff but foldable board material and containing at least two rows of identical cylindrical cans, which carton is of right parallelepipedic shape and includes (a) a handle which extends parallel to and is intersected by a median plane lying between said at least two adjacent rows of cans, and (b) a precursor of an access flap to gain access to the packaged cans, the access flap being delineated by said handle and by two spaced-apart lines of perforations defining respective lines of weakness, the handle including reinforcing material which lies in the said median plane and which extends completely across one wall of the carton and at least partly across two of the walls of the carton adjacent to the said one wall, the reinforcing material being located between handle-defining cuts in the board material which encroach onto said two adjacent walls to define the reinforced handle, the handle forming an obstruction to free passage of packaged cans through the opening revealed by the access flap when the latter is created by tearing the board material along the lines of weakness and displacing the board material along a hinge line extending between said lines generally parallel to the handle.

4. A carton as claimed in claim 3 wherein the lines of weakness are formed one in each of the said two adjacent walls.

5. A carton as claimed in claim 4 wherein the board material is a faced corrugated fibre board having a corrugated sheet with parallel flutes attached to an uncorrugated facing sheet, and the reinforcing material is a tape which extends at right angles to the flutes, the tape being disposed between the corrugated sheet and said facing sheet of the board.

6. A carton as claimed in claim 3, wherein the reinforcing material extends the whole length of the blank and thus surrounds the cans packaged in the carton.

7. A black for packaging a plurality of rows of cylindrical cans having selected outside dimensions, said blank including wall panels defining four walls of a carton and further panels defining two sides of the carton, one of said wall panels including spaced-apart cuts defining a carrying handle therebetween, the blank also including lines of spaced-apart perforations providing respective lines of weakness defining a precursor of an access opening, a length of reinforcing tape being located between the handle-defining cuts, and the two spaced-apart lines of weakness each terminating at the first one of the handle-defining cuts, to define an access flap adapted to be displaced along a hinge line generally parallel to said cuts between said lines of weakness.

8. A blank as claimed in claim 7 said flap having a flap width between said lines of perforations greater than the first outside dimension of the cans parallel to said cuts, and flap depth along the length of the lines of perforations less than the second outside dimension of the cans perpendicular to said cuts, the distance between said hinge line and the second one of said handle-defining cuts being not less than said second dimension.

9. A blank as claimed in claim 7 wherein the reinforcing tape extends across all four wall panels, the handle-defining cuts encroach on the wall panels adjacent to said one panel, and the spaced-apart lines of weakness are formed one in each of said adjacent wall panels.

10. A blank for packaging a plurality of rows of cylindrical cans of a selected diameter comprising panels for defining four walls of a carton, at least one of said panels including spaced-apart cuts defining a carrying handle, wherein a length of reinforcing tape is located between the handle-defining cuts, and two lines of weakness defining a precursor flap for an access opening, said lines being spaced apart by a distance greater than the selected diameter and originating at points spaced from a first of said cuts to provide a hinge line therebetween which is spaced from said first of said cuts less than the selected diameter and from the second of said cuts greater than the selected diameter, and each terminating in said first of the handle-defining cuts.

* * * * *

UNITED STATES PATENT AND TRADEMARK OFFICE

CERTIFICATE OF CORRECTION

PATENT NO. : 4,817,866

DATED : April 4, 1989

INVENTOR(S) : Roger J. Wonnacott

It is certified that error appears in the above-identified patent and that said Letters Patent is hereby corrected as shown below:

Col. 1, line 29, "black" should be --blank--;

Col. 1, line 36, "across" should be --access--;

Col. 1, line 64, "al" should be --all--;

Col. 3, line 51, "twelvecan" should be --twelve-can--;

Col. 3, line 53, "black" should be --blank--;

Col. 3, line 68, "thr" should be --the--;

Col. 3, line 68, "to" should be --the--;

Col. 6, line 9, "black" should be --blank--.

Signed and Sealed this

Tenth Day of October, 1989

*Attest:*

DONALD J. QUIGG

*Attesting Officer*

*Commissioner of Patents and Trademarks*